US007032482B1

(12) United States Patent
Hoffman

(10) Patent No.: US 7,032,482 B1
(45) Date of Patent: Apr. 25, 2006

(54) TENSIONING DEVICE APPARATUS FOR A BOTTOM FEED SCREW DRIVING TOOL FOR USE WITH COLLATED SCREWS

(75) Inventor: William H. Hoffman, Cincinnati, OH (US)

(73) Assignee: Senco Products, Inc., Cincinnati, OH (US)

( * ) Notice: Subject to any disclaimer, the term of this patent is extended or adjusted under 35 U.S.C. 154(b) by 0 days.

(21) Appl. No.: 10/953,422

(22) Filed: Sep. 29, 2004

Related U.S. Application Data

(60) Provisional application No. 60/516,947, filed on Oct. 31, 2003.

(51) Int. Cl.
*B25B 23/04* (2006.01)
*B21J 15/28* (2006.01)

(52) U.S. Cl. ..... 81/434; 81/433; 81/57.1; 227/8

(58) Field of Classification Search ..... 81/434, 81/433, 435, 431, 57.1, 57.3; 227/136, 137, 227/139, 2, 8, 10; D8/64, 65, 66
See application file for complete search history.

(56) References Cited

U.S. PATENT DOCUMENTS

| | | | | |
|---|---|---|---|---|
| 4,014,488 | A | | 3/1977 | Potucek et al. |
| 4,404,877 | A | | 9/1983 | Mizuno et al. |
| 4,774,863 | A | | 10/1988 | Geist |
| 4,784,026 | A | * | 11/1988 | Kobayashi et al. ..... 81/430 |
| 5,083,483 | A | | 1/1992 | Takagi |
| 5,109,738 | A | | 5/1992 | Farian et al. |
| 5,167,174 | A | | 12/1992 | Fujiyama et al. |
| 5,337,636 | A | | 8/1994 | Shea |
| D358,749 | S | | 5/1995 | Matsunaga et al. |
| 5,473,965 | A | | 12/1995 | Chen |
| D368,216 | S | | 3/1996 | Hattori |
| 5,687,624 | A | | 11/1997 | Tsuge et al. |
| 5,715,982 | A | | 2/1998 | Adachi |
| 5,772,096 | A | | 6/1998 | Osuka et al. |
| 5,810,239 | A | | 9/1998 | Stich |
| 5,974,918 | A | * | 11/1999 | Nakagawa et al. ..... 81/434 |
| 5,988,026 | A | * | 11/1999 | Reckelhoff et al. ..... 81/434 |
| 6,016,946 | A | | 1/2000 | Phillips et al. |
| D420,877 | S | | 2/2000 | Schultz |
| D420,879 | S | | 2/2000 | Watson et al. |
| 6,045,024 | A | | 4/2000 | Phillips |

(Continued)

FOREIGN PATENT DOCUMENTS

| | | |
|---|---|---|
| AU | 27254/77 | 1/1979 |

(Continued)

*Primary Examiner*—Lee D. Wilson
*Assistant Examiner*—Alvin J. Grant
(74) *Attorney, Agent, or Firm*—Frederick H. Gribbell, LLC

(57) ABSTRACT

A portable hand-held screw driving tool is provided for use with collated strips of screws. A collated strip of screws enters from the "bottom" area of the tool and runs through a fixed guide along a front area of the tool's handle, and then to a movable slide body having a rotatable sprocket that receives the collated strip, and indexes the strip so a screw can be driven by the tool. Between the slide body and the fixed guide is a flexible strap with a bracket that places tension on the collated screw strip, which prevents the flexible collated strip from becoming substantially misaligned (e.g., bunching, sagging, or becoming tangled) in the area between the fixed guide and the slide body. The collated strip is kept sufficiently taut, regardless of the orientation of the screw driving tool with respect to the ground.

27 Claims, 8 Drawing Sheets

U.S. PATENT DOCUMENTS

| | | | | | |
|---|---|---|---|---|---|
| 6,062,113 | A | * | 5/2000 | Nakano et al. | 81/434 |
| 6,089,132 | A | * | 7/2000 | Habermehl | 81/434 |
| 6,155,139 | A | * | 12/2000 | Tanji | 81/57.44 |
| 6,158,643 | A | | 12/2000 | Phillips | |
| D436,511 | S | | 1/2001 | Hayakawa | |
| 6,179,192 | B1 | | 1/2001 | Weinger et al. | |
| D438,079 | S | | 2/2001 | Hattori | |
| 6,244,140 | B1 | * | 6/2001 | Habermehl | 81/434 |
| D461,694 | S | * | 8/2002 | Buck | D8/68 |
| D462,001 | S | * | 8/2002 | Bohart et al. | D8/68 |
| 6,892,921 | B1 | * | 5/2005 | Beville | 227/109 |

FOREIGN PATENT DOCUMENTS

| | | |
|---|---|---|
| DE | 41 19 925 | 1/1992 |
| DE | 42 08 715 | 9/1992 |
| DE | 195 26 543 | 1/1996 |
| EP | 0 058 986 | 9/1982 |
| EP | 0 623 426 | 11/1994 |

* cited by examiner

TENSIONING DEVICE APPARATUS FOR A BOTTOM FEED SCREW DRIVING TOOL FOR USE WITH COLLATED SCREWS

CROSS-REFERENCE TO RELATED APPLICATIONS

The present application claims priority to provisional patent application Ser. No. 60/516,947, titled "Tensioning Device for Collated Screw Driving," filed on Oct. 31, 2003.

TECHNICAL FIELD

The present invention relates generally to portable screw driving equipment and is particularly directed to a motorized tool of the type which receives a flexible strip of collated screws, and automatically drives individual screws from the collated strip into an object. The invention is specifically disclosed as a portable screw driving tool that receives a flexible collated strip of screws from a "bottom" area of the tool, and keeps a sufficient amount of tension on the flexible collated strip so as to prevent the strip from becoming substantially misaligned, such as by sagging, or otherwise bunching up or becoming tangled, before the strip reaches the screw-driving front position of the tool. The collated strip is kept sufficiently taut, regardless of the orientation of the screw driving tool with respect to the ground, as a source of gravity.

The screw driving tool has a fixed guide along a front area of its handle, through which the collated strip of screws passes; the tool also has a slide body in its front or "nose" area, and a rotatable sprocket receives the collated strip for positioning the screws in a proper location and orientation for being driven into a solid object. Between the slide body and the fixed guide is a flexible strap with a bracket that places tension on the collated screw strip, and prevents the strip from becoming substantially misaligned, such as by bunching or sagging in the area between the fixed guide and the slide body.

BACKGROUND OF THE INVENTION

Portable hand-held screw driving tools have been available from Senco Products, Inc. for several years. Some of the previous tools sold by Senco were used with screw lengths in the range of one inch to two inches. Many of these tools have been "bottom feed" tools, in which a flexible collated strip of screws was fed from the bottom portion of the tool toward the front or nose of the tool, where the individual screws are taken from the collated plastic strip and driven into a solid object.

The flexible screw strips can be difficult to manage, and at times it is difficult to prevent the screws from bunching or tangling during a driving sequence. This tangling/bunching phenomena can occur when the collated screws have been fed into a slide body mechanism, and once the driving mechanism has been actuated, the screws will have a tendency to cross over one another, perhaps creating a jam or a misfeed. This may occur whether the tool is being driven in a horizontal or a vertical plane (or at other angles).

In the earlier tools sold by Senco, the collated strip of screws did not tend to readily become bunched or tangled during drive sequences of the tool, for two main reasons: (1) the screws were shorter and were not very heavy, and (2) the distance between the guide portion of the handle and the nose piece of the tool was fairly short, thereby providing a lesser distance within which the collated strip could possibly become bunched or tangled, or otherwise sag. Examples of such screw driving tools that have been available in the past are Senco Tool Model No. DS 162-14V and Senco Tool Model No. DS200-14V.

It would be an improvement to provide a portable hand-held screw driving tool that could be used with longer screws that were provided on a collated strip, but at the same time provide a means for preventing the collated strip from sagging or otherwise bunching or tangling.

SUMMARY OF THE INVENTION

Accordingly, it is an advantage of the present invention to provide a portable hand-held screw driving tool that can feed a collated strip of screws from the bottom portion to the nose of the tool in a manner that prevents the flexible collated strip from becoming substantially misaligned, e.g., from substantially bunching, tangling, or sagging.

It is another advantage of the present invention to provide a portable hand-held screw driving tool that has a guide member as part of a handle portion of the tool that initially feeds a flexible collated strip of screws therethrough, and then passes the collated strip of screws toward a front or nose portion of the tool, while also providing a tensioning device to prevent the collated strip of screws from becoming substantially misaligned, e.g., from substantially sagging, bunching, or becoming tangled.

It is yet another advantage of the present invention to provide a portable hand-held screw driving tool that accepts a flexible collated strip of rather lengthy screws through a guide member of a bottom handle region of the tool, feeds that flexible collated strip of screws toward a front driving portion of the tool, and provides a flexible strap with a bracket to provide tension on the flexible collated strip of screws to prevent the strip of screws from becoming substantially misaligned, e.g., from substantially sagging, bunching, or becoming tangled.

It is still another advantage of the present invention to provide a portable hand-held screw driving tool that accepts a flexible collated strip of screws of a longer length, such as in the range of 2–3 inches and which are heavier than shorter 1–2 inch screws, and which guides the collated strip through a fixed guide member on the handle portion of the tool toward a front or nose portion of the tool, and which provides a flexible strap that runs between the fixed guide and the nose portion of the tool, and which prevents the flexible collated strip of screws from becoming substantially misaligned, e.g., from substantially bunching, tangling, or sagging.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a tensioning device for a portable fastener-driving tool is provided, in which the fastener-driving tool exhibits: (i) a housing; (ii) a handle attached to the housing; (iii) a first guide member proximal to the handle, for receiving and guiding a collated strip of fasteners; (iv) a fastener driving area at one end of the housing; and (v) a fastener indexing portion proximal to the fastener driving area, for receiving the collated strip of fasteners and moving a fastener of the collated strip of fasteners to a driving position; and wherein the first guide member and the fastener indexing portion are spaced-apart from one another; and in which the tensioning device comprises: (a) a longitudinal strap having a first end and a second end, wherein the first end is in communication with the fastener indexing portion, and the second end is in communication with the first guide member; and (b) a second guide member that is attached to the strap and is capable of receiving the collated strip of fasteners, the second guide member being positioned between the first and second ends of the strap.

In accordance with another aspect of the present invention, a portable fastener-driving tool is provided, which comprises: (a) a housing containing a driving mechanism; (b) a handle attached to the housing; (c) a first guide member proximal to the handle, the first guide member having a first opening and a second opening, the first guide member being capable of directing a collated strip of fasteners between the first and second openings; (d) a fastener driving area at one end of the housing; (e) a fastener indexing portion proximal to the fastener driving area that is capable of receiving the collated strip of fasteners and moving a fastener of the collated strip of fasteners to a driving position; (f) wherein, when actuated, the driving mechanism operates to drive a fastener at the driving position from the collated strip of fasteners; (g) wherein the first guide member and the fastener indexing portion are spaced-apart from one another, and (h) wherein the collated strip of fasteners traverses a distance between the first guide member and the fastener indexing portion; and (j) a tensioning device, comprising: (i) a longitudinal strap having a first end and a second end, wherein the first end is in communication with the fastener indexing portion, and the second end is in communication with the first guide member; and (ii) a second guide member that is attached to the strap and is capable of receiving the collated strip of fasteners, the second guide member being positioned between the first and second ends of the strap; wherein: when the collated strip of fasteners is positioned within both the first guide member and the second guide member, and is in communication with the fastener indexing portion, a combination of the strap and the second guide member prevents the collated strip of fasteners from becoming substantially misaligned in a region between the first guide member and the fastener indexing portion.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
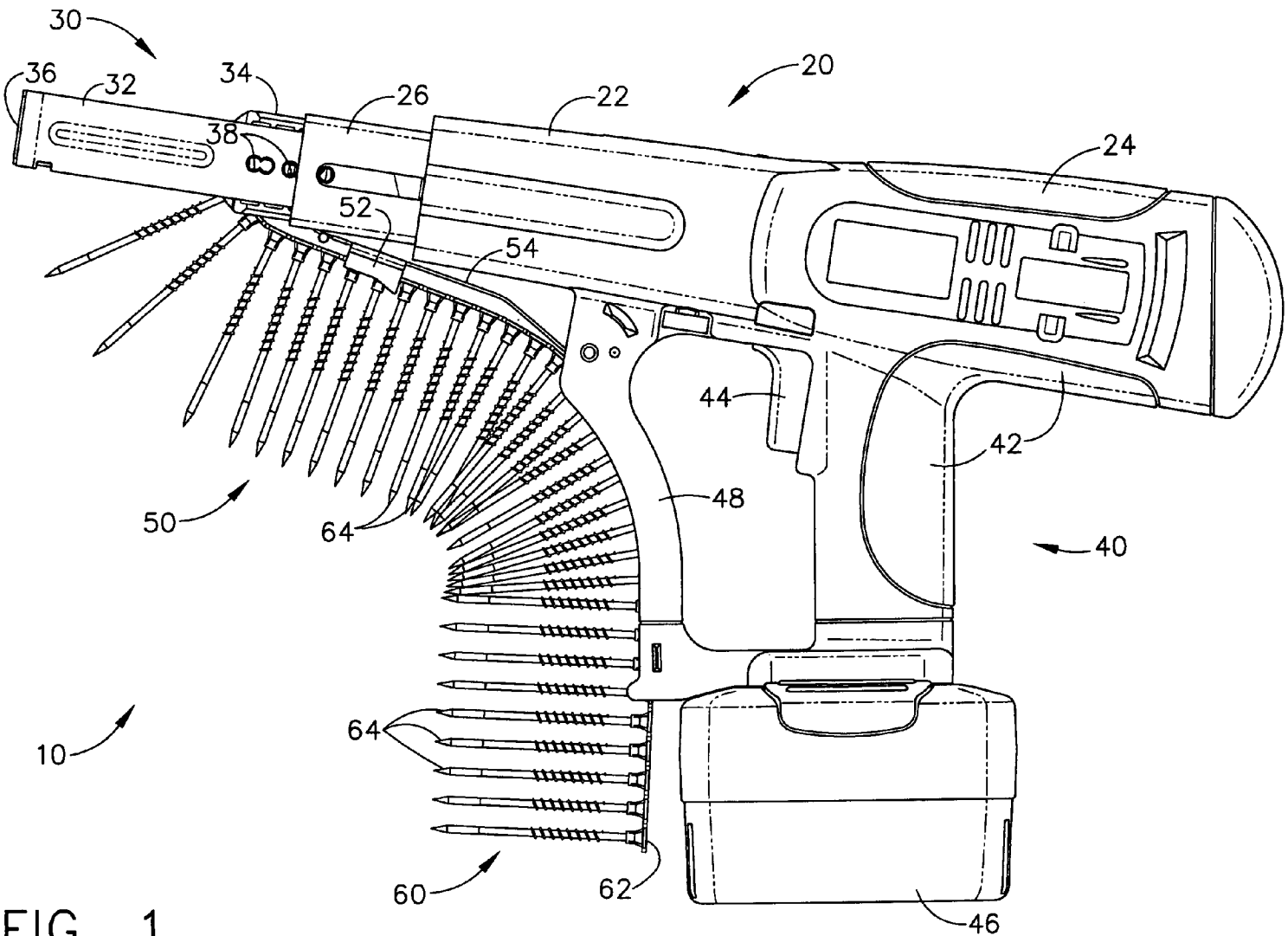
FIG. 1 is a side elevational view of a portable hand-held screw driving tool that accepts a flexible collated strip of screws from a bottom portion of the tool, as constructed according to the principles of the present invention.

Referring now to the drawings, FIG. 1 shows a hand-held screw driving tool, generally designated by the reference numeral 10, that includes a housing portion 20, a front end portion 30, a handle portion 40, and a screw feed portion 50. Screw driving tool 10 is designed for use with a flexible strip of collated screws, and in FIG. 1, the flexible collated screw strip sub-assembly is generally designated by the reference numeral 60.

The housing portion 20 of the tool includes a front housing outer shell structure 22, and a rear housing portion that has a top gripping surface 24 as well as a bottom gripping surface (or set of surfaces) 42, that are also part of the handle portion 40. Toward the front of housing portion 20 is a feed tube 26, that houses some moveable portions of the tool 10, as discussed below. In the illustrated embodiment, the feed tube 26 is fixedly attached to the internal mechanical mechanisms contained within housing portion 20.

The front end portion 30 includes a moveable nose piece 32, which is attached to a slide body sub-assembly 34. Both the nose piece 32 and slide body sub-assembly 34 are moveable in a longitudinal direction of the tool 10, and when the nose piece 32 is pressed against a solid object, the screw driving tool 10 will be actuated to physically drive one of the screws into the solid object, also referred to herein as the "workpiece." Nose piece 32 has a front surface 36, which preferably has a rough texture such as sandpaper, so that it will not easily slide while pressed against the surface of the workpiece when the tool is to be utilized. In the illustrated embodiment of FIG. 1, the nose piece 32 is detachable from the slide body sub-assembly 34 so that the nose piece can be re-positioned for different lengths of screws. The nose piece 32 has a plurality of screw length positioning holes 38, which are used to attach nose piece 32 to the slide body sub-assembly 34 at different relative positions to one another.

Handle portion 40 includes a set of bottom gripping surfaces 42 that can be used by a person's hand to readily grip the handle and not easily slide along the bottom surface of the housing portion 20. Handle portion 40 also includes a trigger 44, which is used to actuate an electrical switch to operate the internal drive mechanisms of the hand-held portable tool 10. In the illustrated embodiment, a battery sub-assembly 46 is attached at the bottom area of handle portion 40, which provides electrical power to the internal drive mechanism of the tool 10.

Handle portion 40 also includes a curved guide member 48 that can receive a flexible collated strip of screws, in this case the collated screw sub-assembly 60. The collated screw sub-assembly 60 mainly consists of a plastic strip 62 that has several openings to receive individual screws 64. The overall collated screw sub-assembly is flexible to a certain degree, as can be seen in FIG. 1 by the curved orientation of the plastic strip 62 as it is fed through the guide 48 and up toward the nose piece 32 and the slide body sub-assembly 34.

Much of the mechanical mechanisms described above for the portable screw driving tool 10 has been available in the past from Senco Products, Inc., including such tools as the Senco Model Nos. DS162-14V and DS200-14V. These earlier tools may not have had the precise same construction as described above in reference to FIG. 1, but there are certainly some similarities.

With regard to the present invention, a flexible strap 54 is provided which runs between an attachment point in the slide body sub-assembly 34 and into an opening of the guide 48. Strap 54 provides both mechanical strength and a sliding surface for the plastic strip 62 of the collated screw sub-assembly 60. Attached to the more forward position of the strap 54 is a bracket 52. This bracket is shaped to receive the plastic strip 62 and to allow the screws 64 to have their shanks pass through an opening in the bracket 52 as the collated screw sub-assembly 60 passes toward the slide body sub-assembly 34. Further details of this construction are provided below.

Figure 2:
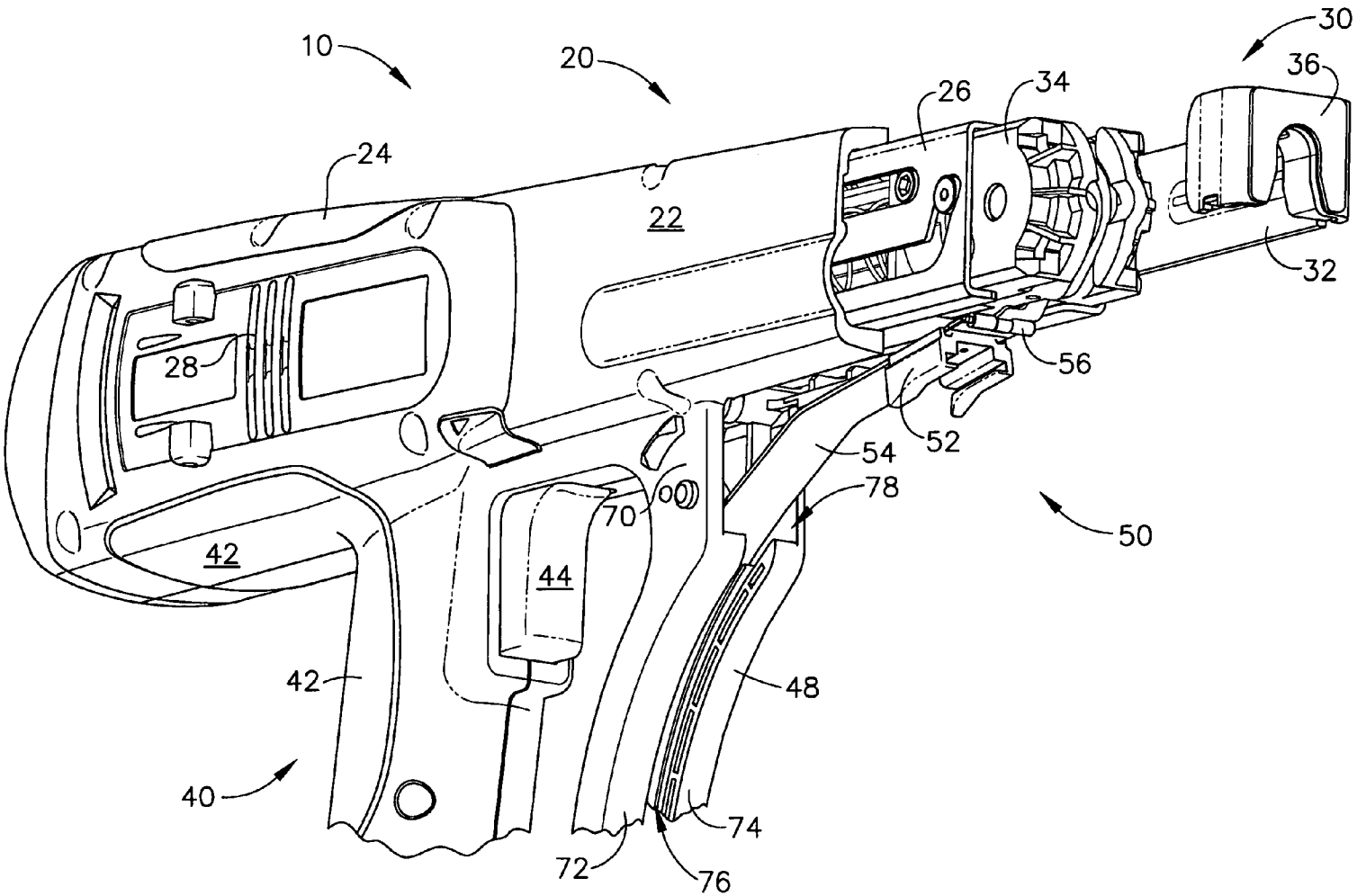
FIG. 2 is a perspective view from the front and opposite side of the screw driving tool of FIG. 1, showing further details of the screw driving tool without the collated strip of screws.

Referring now to FIG. 2, some of the mechanical details of the portable screw driving tool 10 can be better seen in this view without the collated screw sub-assembly. In FIG. 2, there are several ventilation slots 28 that can be seen in the side of the tool housing, below the top gripping surface 24. This allows ventilating air to help cool the motor and other mechanical components therewithin.

Also more easily seen in FIG. 2 are the details of some of the shapes of the bottom guide 48, which has a curved surface toward the front portions of the tool 10. The guide 48 includes a vertical member 70 that extends between the curved portion of the guide 48 to the uppermost portion of the guide, along the bottom surface of the front housing 22 of the tool 10. The curved portions of the guide 48 are actually divided into two halves, in which the two halves are generally designated by the reference numerals 72 and 74. As seen in FIG. 2, the guide half 72 is the "left" guide half, while the other guide half is the "right" guide half 74; this is from the front perspective of the tool 10. Between these two guide halves 72 and 74 is an open slot 76, which is used to guide the shanks of the individual screws 64 as they move along the guide's pathway toward the front nose piece 32 and slide body sub-assembly 34.

Additional details of the strap 54 can also be seen in FIG. 2. The bracket 52 is seen as having openings to allow the plastic strip 62 portion of the collated screw sub-assembly 60 to pass through the bracket 52. Further details of this will be described below. Strap 54 protrudes into an open top area at 78 of the guide 48. Strap 54 is attached to the slide body sub-assembly at a pivot link, which uses a hinge pin 56. Further details of this construction are discussed below. As will be seen in later views, the plastic strip 62 of the collated screw sub-assembly 60 will slide along the strap 52, through the bottom guide 48, through a portion of the bracket 52, and up to the front areas of the slide body sub-assembly 32.

Figure 3:
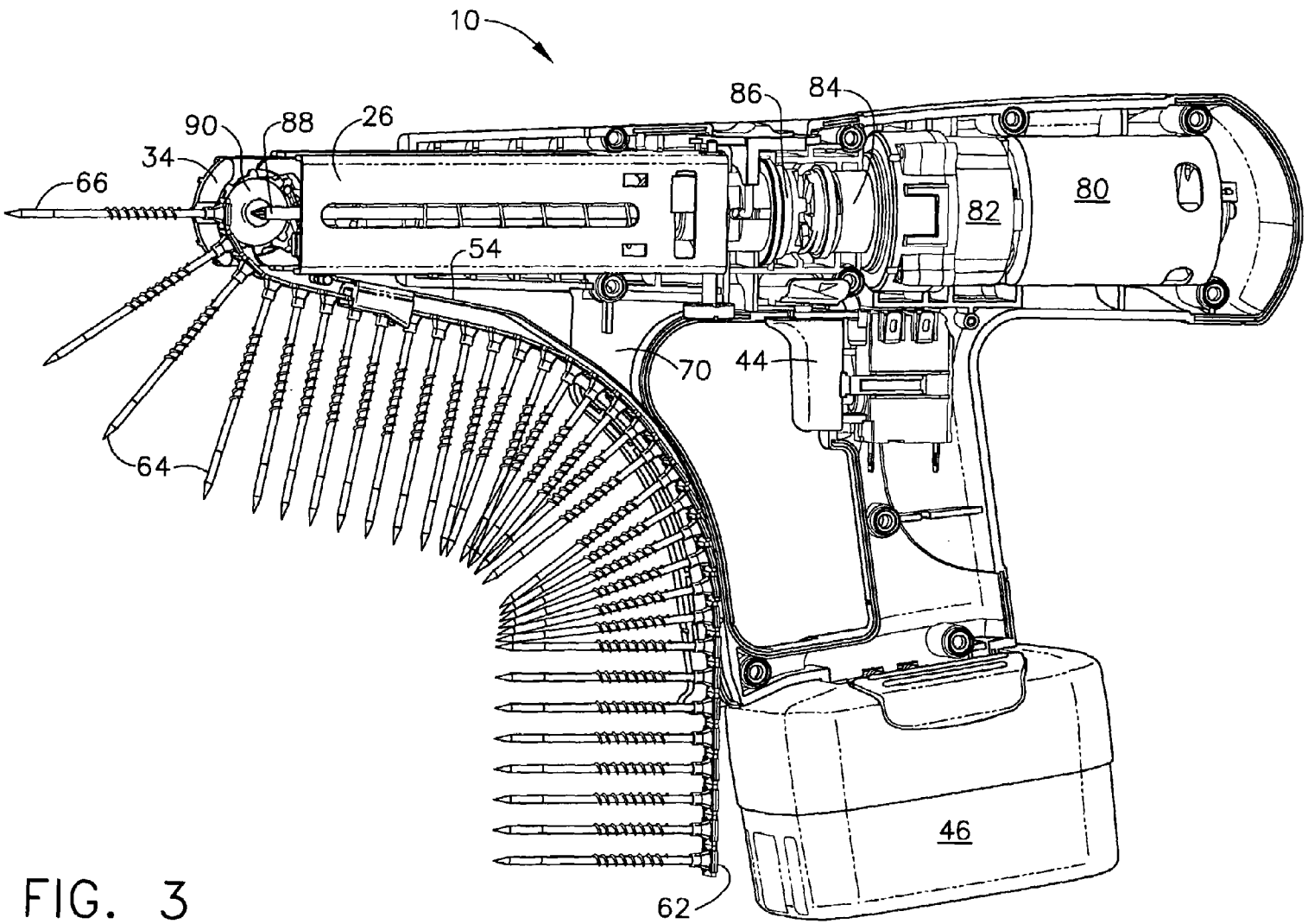
FIG. 3 is a side elevational view in partial perspective, showing the screw driving tool of FIG. 1 in a partial cross-section view.

Referring now to FIG. 3, some of the internal components of the portable screw driving tool 10 are illustrated. An electric motor 80 is positioned within the housing at the rear-most portion of the tool 10. Motor 80 drives into a gearbox 82, which in turn drives a clutch drive member 84. A clutch driven member 86 is selectively engaged by the clutch drive member 84 when it is time to drive a screw.

When viewing the tool at its front-most portion (i.e., the left-hand portion as viewed in FIG. 3), it can be seen that one of the screws has been indexed to a "drive" position at 66 and is now co-linear with the main drive components of the portable tool 10. As the collated screw sub-assembly 60 is moved through the various "guided" pathways, the plastic strip 62 will eventually make contact with a sprocket 90 that acts as a rotary indexer, which moves each of the portions of the plastic strip 62 into a proper position so that their attached screw 64 eventually ends up in the front-most drive position 66.

When the nose piece 32 (not seen in FIG. 3) is actuated by being pressed against a workpiece (not seen in FIG. 3), then a drive bit 88 will move in a linear fashion to push the screw at 66 into the workpiece, and the drive bit 88 will also then be turned in a rotary motion to twist the screw at 66 in the normal manner for driving a screw 64 into a solid object. Once the screw at 66 has been successfully driven into the solid object, then the tool 10 is withdrawn from the surface of the solid object, and of course the screw 64 remains behind and has broken free from the plastic strip 62. The tool 10 is now free to allow the sprocket 90 to perform its rotary indexing function and to bring forth the next screw 64 into the front-most drive position. This type of screw-feed actuation can be referred to as "indexed on return," since the "lead screw" is moved into the "firing position" at 66 as the nose piece 32 is released (or "returned") from the surface of the workpiece.

The tool 10 can also be configured in an alternative screw-feed actuation mode, in which the lead screw is moved into the firing position at 66 as the nose piece 32 is pressed against the surface of a workpiece; this type of screw-feed actuation can be referred to as "indexed on advance." If tool 10 is configured for indexed on advance, then the lead screw would not yet be in the position at 66 (as seen on FIG. 3) at the moment the nose piece 32 is "relaxed" in its non-firing state. Instead, the lead screw is not indexed into the firing position at 66 until the nose piece 32 is "pushed in" (or "advanced") toward the main body portion of the tool 10 (e.g., toward the handle portion 40), which is a state of the tool illustrated in FIG. 8, and discussed below in greater detail. Note that the indexed on advance configuration is a preferred mode of operation for tool 10.

It will be understood that both the indexed on advance and indexed on return screw-feed actuation modes of operation can work equally well with the flexible strap 54 and bracket 52 of the present invention. Other possible modes of screw-feed actuation might be developed in the future that would also work well with the flexible strap 54 and bracket 52 of the present invention.

Figure 4:
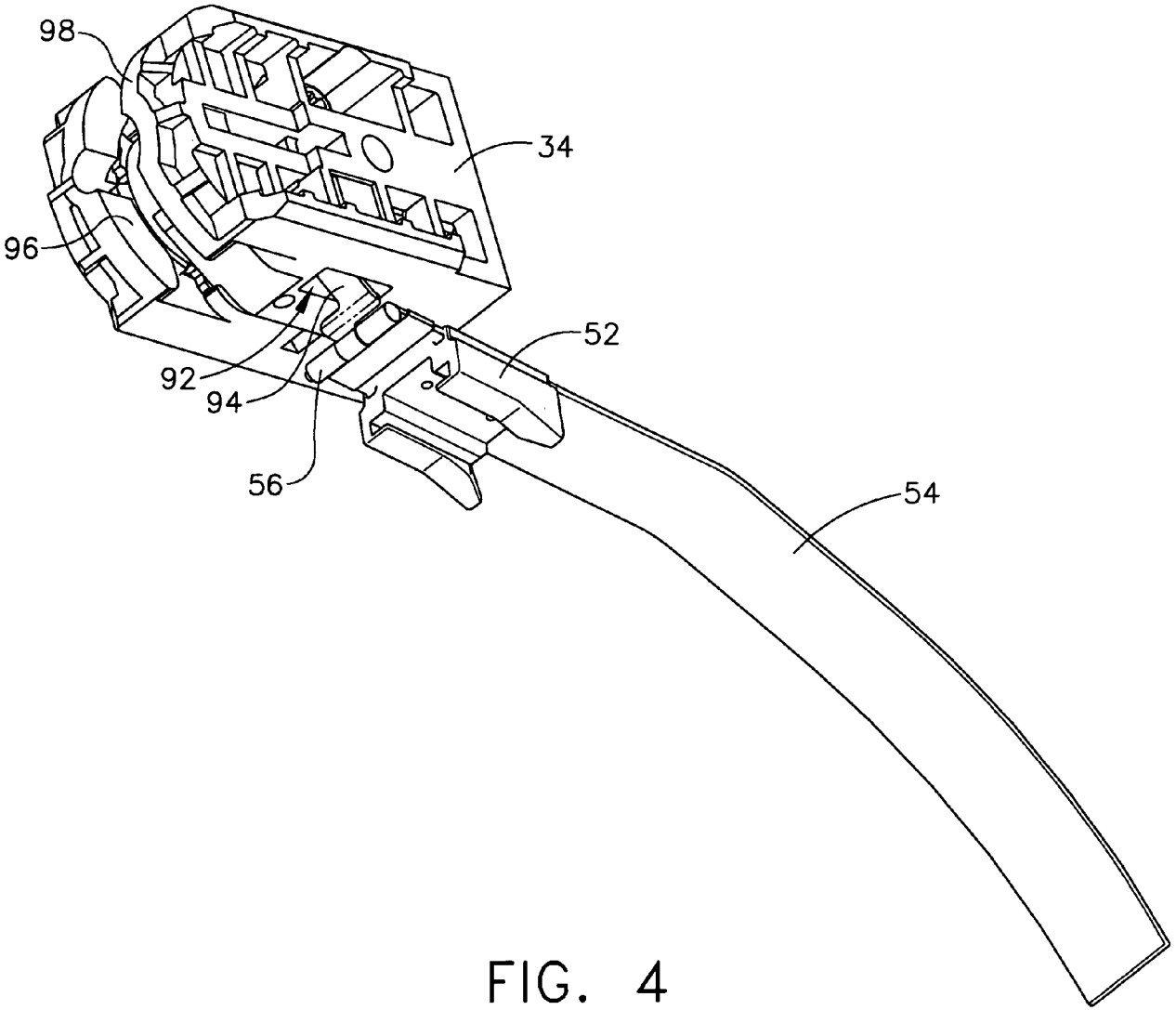
FIG. 4 is a perspective view of a flexible strap and slide body sub-assembly, which is used on the tool of FIG. 1 to provide tension on the flexible collated strip of screws.

Referring now to FIG. 4, a front portion of the strap 54 is illustrated, as it is attached to the slide body sub-assembly 34. Strap 54 is connected by a pivot link hinge pin 56 to a pivot link member 94, which fits into the slide body sub-assembly at an opening 92 in the slide body sub-assembly 34. The details as to the attachment of the pivot link 94 to the slide body sub-assembly 34 are discussed below.

The slide body sub-assembly 34 is also comprised of two separate halves at its front-most areas. The two halves are designated by the reference numerals 96 and 98, and they provide a guide surface for the shanks of the screws as they are being moved forward to the final drive position (at 66, illustrated in FIG. 3). Strap 54 also has the bracket 52 attached thereto, and as discussed above, this bracket has an open area and some guide surfaces that assist in guiding the plastic strip 62 of the collated screw sub-assembly 60. This will also be discussed below in greater detail.

Figure 5:
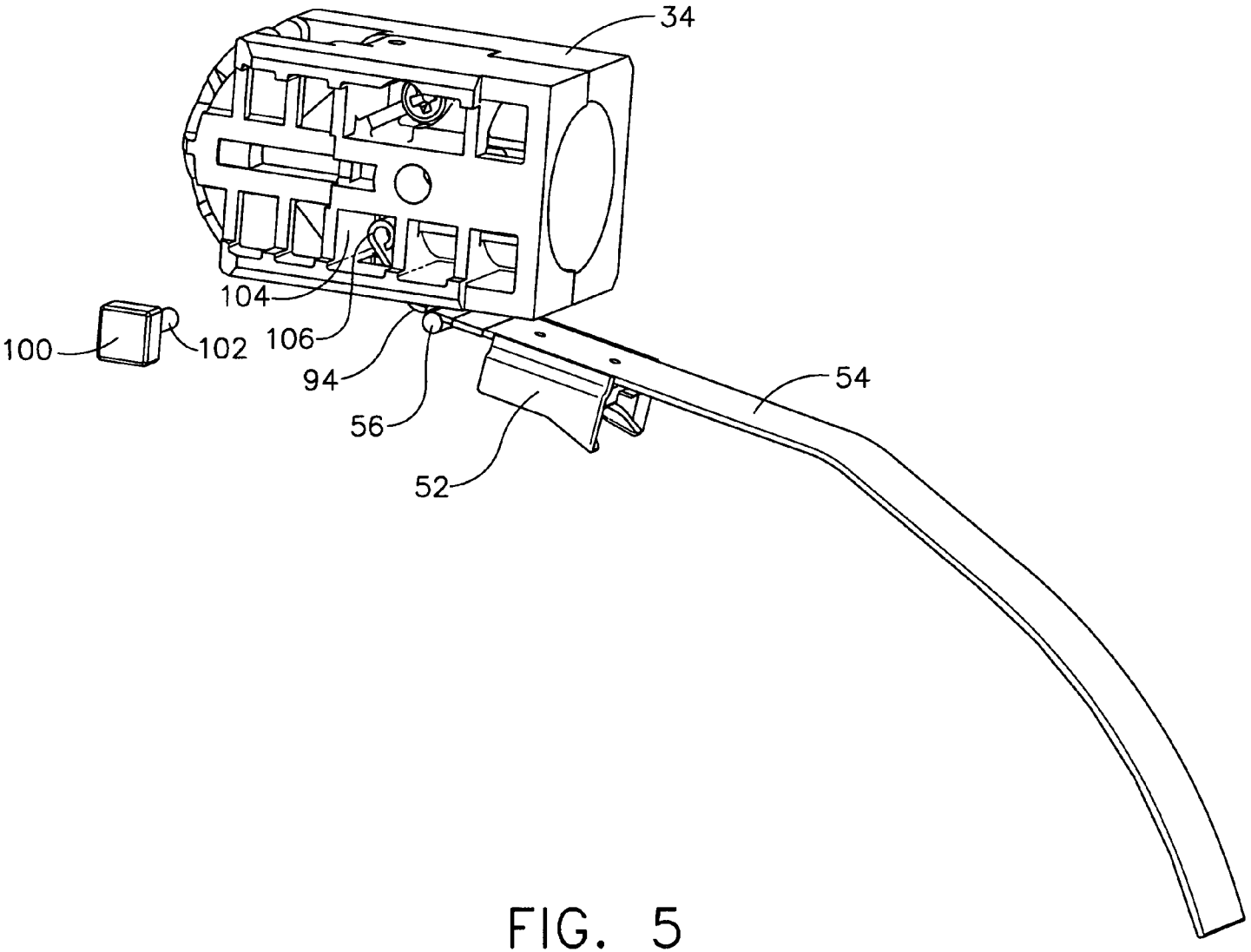
FIG. 5 is a perspective view from the side and slightly from above and behind of the flexible strip and slide body sub-assembly of FIG. 4, and also showing details of the retainer parts that hold the flexible strap to the slide body sub-assembly.

Referring now to FIG. 5, the slide body sub-assembly 34 and strap 54 are once again illustrated, this time from a different angle as compared to that depicted in FIG. 4. A small portion of the pivot link 94 is visible where it connects to the hinge pin 56 in FIG. 5. Another portion of the pivot link 94 is visible at 106, which comprises the arcuate end of this pivot link 94.

There are several openings in the slide body sub-assembly 34 in the side facing the viewer of FIG. 5. One of these openings is a square-shaped opening at 104. A retaining pin has a square "head" portion 100 that fits into the square-shaped opening 104. The retaining pin also includes a rod portion 102, in which the rod 102 fits within the arcuate-shaped opening of the end 106 of the pivot link 94. This is the mechanism that holds the pivot link 94 mechanically with the slide body sub-assembly 34 in the illustrated embodiment. The retaining pin is held in place by the nose piece 32 when it is installed to the slide body sub-assembly 34.

Since the arcuate surface of the pivot link at 106 fits around the rod 102 of the retaining pin, the pivot link 94 can rotate or pivot about the centerline axis of the rod 102. The hinge pin 56 also allows the pivot link to rotate or pivot about the end portion of the strap 54. The different orientations thereby enabled with this construction will allow the strap 54 and slide body 34 to move along a linear pathway inside the feed tube 26 as the nose piece 32 is depressed when it is placed against a solid object that is going to have a screw driven thereinto. The different possible angular orientations of the pivot link 94 with respect to other portions of the tool 10 are better illustrated in FIGS. 7 and 8. This will be discussed below in greater detail.

Figure 6:
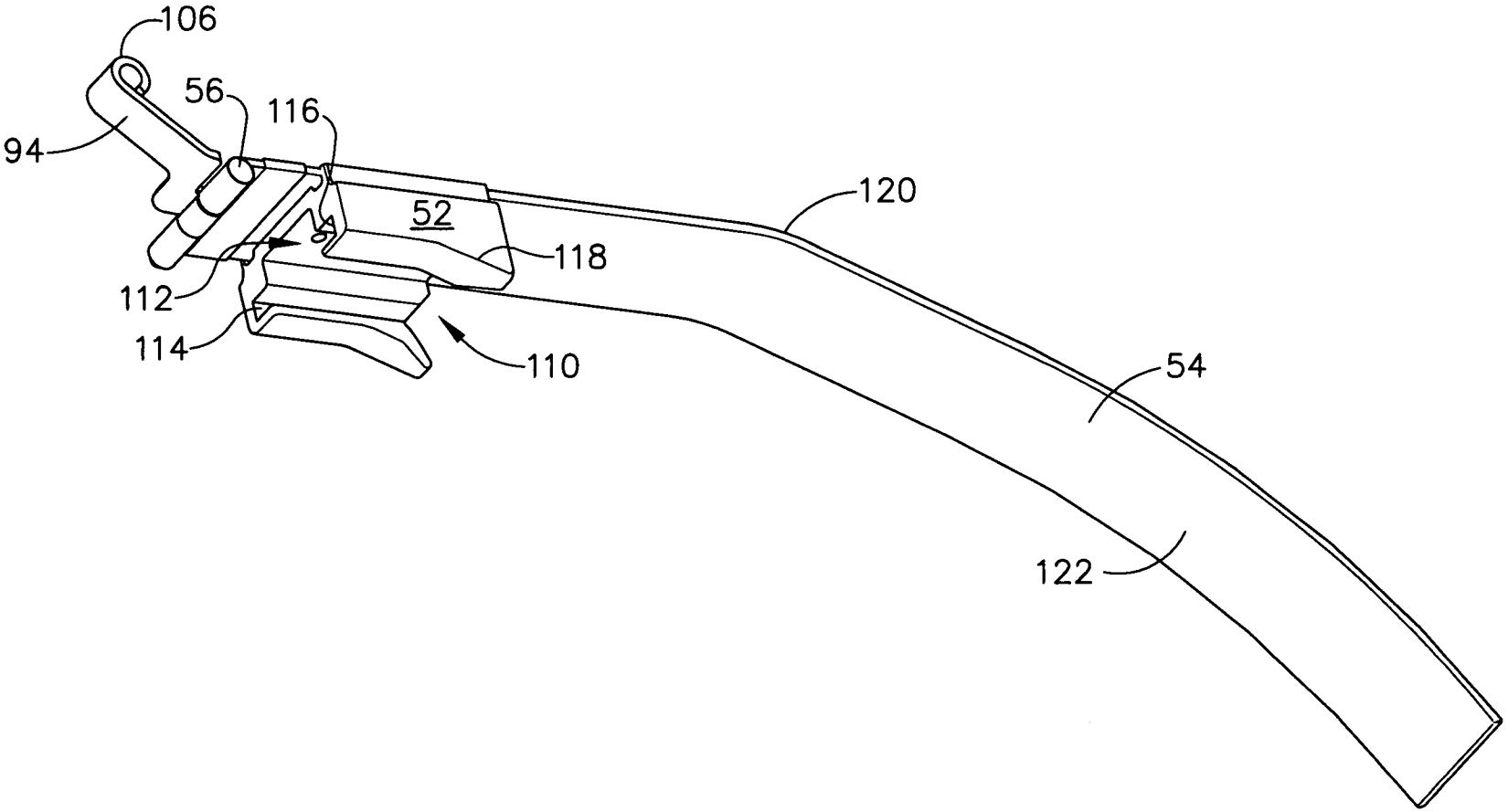
FIG. 6 is a perspective view from below and somewhat from the front of the flexible strap used to provide tension on the flexible collated strip of screws used with the tool of FIG. 1.

Referring now to FIG. 6, the entire strap 54 with bracket 52 and pivot link 94 are illustrated as a single sub-assembly. The arcuate front member of the pivot link 94 is easily seen at 106 in this view. The hinge pin 56 is also easily seen, as it connects into an end portion of the strap 54.

Some of the details of bracket 52 are now illustrated, and will now be discussed in detail. Bracket 52 includes a rear opening 110 and a front opening 112. The plastic strip 62 of the collated screw sub-assembly 60 passes through these openings, when the plastic strip 62 is being indexed toward the front of the tool 10. These openings 110 and 112 are formed by two guide members formed in the bracket 52. Each guide member forms one-half of two guiding surfaces, which are designated by the reference numerals 114 and 116. The outer edges of the plastic strip 62 will run through these guide surfaces 114 and 116.

As can been seen in FIG. 6, the bracket 52 has an angled member 118 near the rear opening 110. This allows the rear opening 110 to be flared so that it can receive (and pass through) the plastic strip 62 from a variety of angles. It also allows the human user to install a plastic strip 62 more easily into the rear opening 110 of the bracket 52, as the tool 10 is first being "loaded" with a collated screw sub-assembly 60.

The strap 54 illustrated in FIG. 6 exhibits a bend at 120, and a curved or arcuate portion at 122. Such a bend is useful, but is not necessarily critical to the proper working of the strap 54 in the present invention. Furthermore, if a bend is to be placed in the strap 54, it could be placed at different positions, if desired, for different tool sizes and screw sizes that will be provided in a collated screw sub-assembly 60. Moreover, any bend in the strap 54 could also be made at a different angle, if desired. The overall tool shape and dimensions will tend to help determine the more useful bend angle and location along the strap 54.

The curved member 122 of the strap 54 is designed to more readily fit through the curved portion of the guide 48 that is part of the handle portion 40 of the tool 10. Depending upon how flexible or inflexible the strap 54 is to be made, this curved member 122 could be relatively stiff or relatively limber, depending on the designer's choice. It will be understood that the strap 54 should exhibit enough stiffness to support the weight of the collated screw sub-assembly 60 in the area between the front portion 70 of the guide 48 and the rear opening 110 of the bracket 52. This will achieve one of the advantages of the present invention, which is to prevent the collated strip sub-assembly 60 from substantially sagging or bunching, or otherwise allowing the screws 64 to become tangled because of some type of misalignment in the collated screw sub-assembly 60 that might otherwise occur.

Figure 7:
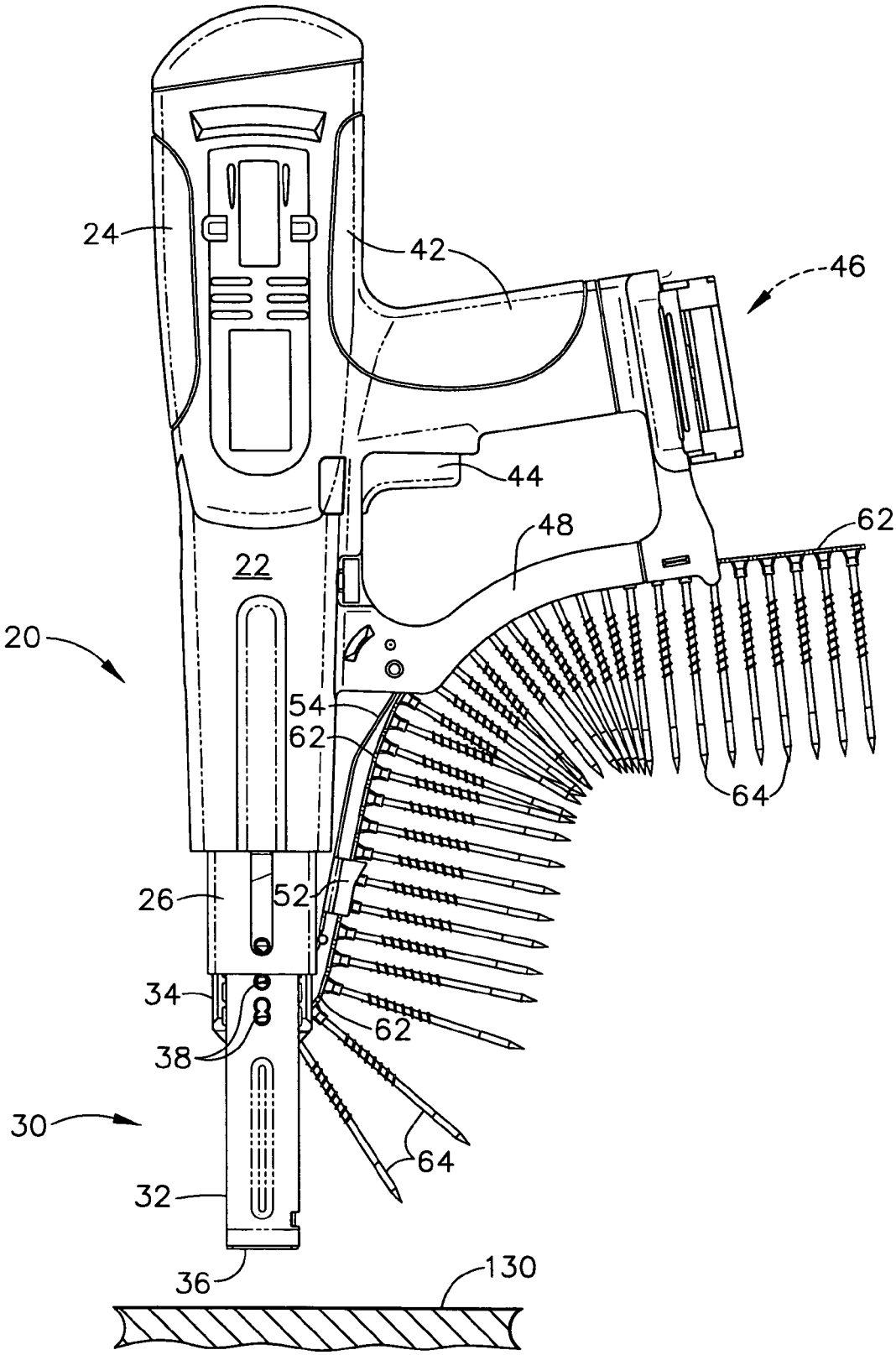
FIG. 7 is a side elevational view of the screw driving tool of FIG. 1, depicted in a vertical working position in its "relaxed" non-firing mode before being pressed against a work surface.

Referring now to FIG. 7, the tool 10 is illustrated as being oriented in a vertical manner, ready to be pressed against a solid object 130, such as a patio deck for example. In this orientation, the weight of a lengthy screw 64 might tend to sag the plastic strip 62 of the collated screw sub-assembly 60. As can be seen in FIG. 7, the plastic strip 62 runs through the guide bracket 52, and runs mainly parallel to the strap 54. Strap 54 runs into the open area of the curved guide 48 of the handle portion 40. Bracket 52 and the strap 54 provide a tension on the collated screw sub-assembly 60, and thus will not allow the plastic strap 62 to substantially sag or otherwise bunch up.

Figure 8:
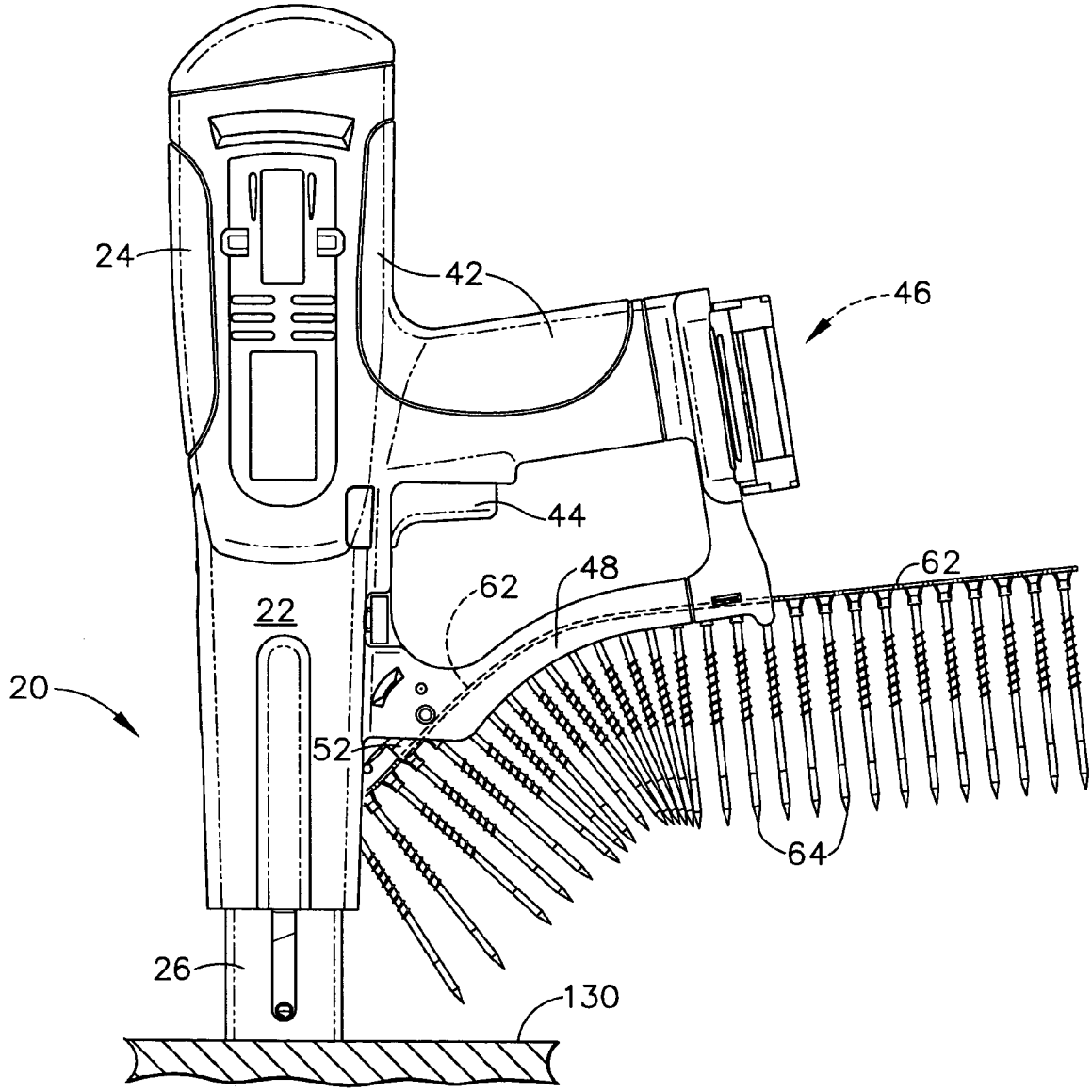
FIG. 8 is a side elevational view of the screw driving tool of FIG. 1 depicted in a vertical working position and in its actuated, firing position as the nose piece is pressed against a work surface.

While FIG. 7 depicted the tool 10 in a relaxed or "non-firing" position, FIG. 8 illustrates the tool 10 in its "firing" position, in which the nose piece 32 has been placed against the solid object 130 and pressed down such that the nose piece 32 has slid linearly upward in FIG. 8 inside the feed tube 26. Since feed tube 26 is fixedly attached to the front housing 22, the solid surface 130 cannot come any "closer" than the front of the feed tube 26, as seen in FIG. 8. In this position, a screw (at position 66) will be driven into the solid object 130.

In this position, the entire slide body sub-assembly 34 will also have moved linearly upward (in this vertical orientation), and the strap 54 and guide 52 will also have been moved toward the top of this FIG. 8. However, the bracket 52 is pivotally mounted to the slide body sub-assembly 34, as discussed above, and now has a different angular orientation with respect to slide body sub-assembly 34. The plastic strip 62 of the collated screw sub-assembly 60 will have also moved upward in this view, but will not have allowed its screws 64 to become substantially tangled or otherwise bunched up because of the bracket 52. In this activated or firing position, the screw fastener manageability is maintained throughout the driving sequence. Since the tensioning device assembly 52/54 is not fixed to the housing 22, the movable portion of the system is free to slide backward in the feed tube 26, and also to advance the next screw without a malfunction. The feed system will automatically index the next screw 64 while maintaining the screw strip integrity.

Some of the components used in the present invention have been disclosed in a commonly-assigned patent, titled "Screw Feed and Driver for a Screw Driving Tool, U.S. Pat. No. 5,988,026, which is assigned to Senco Products, Inc., and which is incorporated herein by reference in its entirety. Some portions of the present invention have also been disclosed in another commonly-assigned patent, titled "Screw Driving Tool," U.S. Pat. No. Des. 462,001, which is assigned to Senco Products, Inc., and which is incorporated herein by reference in its entirety.

It will be understood that the term "collated screw sub-assembly" as used herein refers to a strip of screws that are temporarily mounted in a flexible strip of material that exhibits openings and other structures to hold the screws in place until they are needed. In many products, the flexible strip of material comprises plastic, but other materials could be used, if desired. The individual screws are advanced to a driving position in a screw driving tool (such as portable tool 10), and each screw is individually driven from the flexible strip by the tool when the tool is actuated.

It will also be understood that the term "flexible strap" as used herein refers to a piece of material that is much longer in its longitudinal direction than its width in a transverse direction that is perpendicular to the longitudinal axis. In one embodiment of the present invention, the strap comprises metal, but other materials could be used, if desired. The strap should be flexible enough to allow itself to be somewhat bent or straightened as the screw driving tool is actuated to drive a screw into a solid material; however, the strap should also be strong enough to support the weight of the collated screw sub-assembly in various orientations, so that the collated screws do not cause the strap to unduly deform.

It will be further understood that the principles of the present invention are applicable to many different types of fastener driving tools, including tools powered by AC electrical power (e.g., 120 VAC line power from an outlet), DC electrical power (e.g., from a battery or a solar panel), a pneumatic power source, or a hydraulic power source, for example. In addition, the types of fasteners that can be driven in the manner of the present invention are not limited to screws, but could instead be nails or rivets, for example.

All documents cited in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. It is intended to cover in the appended claims all such changes and modifications that are within the scope of this invention.

The invention claimed is:

1. A tensioning device for a portable fastener-driving tool, wherein the fastener-driving tool exhibits: (i) a housing; (ii) a handle attached to the housing; (iii) a first guide member proximal to the handle, for receiving and guiding a collated strip of fasteners; (iv) a fastener driving area at one end of the housing; and (v) a fastener indexing portion proximal to the fastener driving area, for receiving the collated strip of fasteners and moving a fastener of the collated strip of fasteners to a driving position; and wherein the first guide member and the fastener indexing portion are spaced-apart from one another;

said tensioning device comprising:

(a) a longitudinal strap having a first end and a second end, wherein said first end is in communication with said fastener indexing portion, and said second end is in communication with said first guide member; and (b) a second guide member that is attached to said strap and is capable of receiving the collated strip of fasteners, said second guide member being positioned between said first and second ends of the strap.

2. The tensioning device as recited in claim 1, wherein: when a collated strip of fasteners is positioned within both said first guide member and said second guide member, and is in communication with said fastener indexing portion, a combination of said strap and said second guide member prevents the collated strip of fasteners from becoming substantially misaligned in a region between said first guide member and said fastener indexing portion.

3. The tensioning device as recited in claim 2, wherein the combination of said strap and said second guide member prevents the collated strip of fasteners from substantially (a) sagging, (b) bunching, and (c) becoming tangled.

4. The tensioning device as recited in claim 1, wherein said fasteners comprise screws.

5. The tensioning device as recited in claim 4, wherein said screws exhibit a length of at least two inches.

6. The tensioning device as recited in claim 1, wherein said longitudinal strap is sufficiently stiff between its first and second ends to, without substantial deformation, support a weight of said collated strip of fasteners between said first guide member and said fastener indexing portion.

7. The tensioning device as recited in claim 6, wherein: (a) said longitudinal strap is exhibits a curved profile with at least one bend, between its first and second ends; and (b) said longitudinal strap is sufficiently flexible to move, without breaking, within a curved portion of said first guide member.

8. The tensioning device as recited in claim 2, wherein said first guide member includes: (a) two arcuate halves that exhibit at least one first guide surface for directing a movement of said collated strip of fasteners therethrough, and (b) at least one second guide surface for directing a movement of shanks of the fasteners therethrough, of said collated strip of fasteners.

9. The tensioning device as recited in claim 2, wherein said second guide member comprises a bracket having: (a) at least one third guide surface for directing a movement of said collated strip of fasteners therethrough, and (b) at least one fourth guide surface for directing a movement of shanks of the fasteners therethrough, of said collated strip of fasteners.

10. The tensioning device as recited in claim 1, wherein said fastener indexing portion comprises a slide body with a rotatable sprocket.

11. The tensioning device as recited in claim 10, further comprising: a movable nose piece in said fastener driving area that moves, along with said slide body, in a substantially linear direction when a fastener is driven, and the first end of said strap moves along with said nose piece and slide body;

wherein said collated strip of fasteners does not become substantially misaligned during said movement of the nose piece, slide body, and strap, including when in the fastener driving position.

12. The tensioning device as recited in claim 11, further comprising: a pivot link member that exhibits a first end and a second end, wherein said first end of the pivot link member is mechanically connected to said first end of the strap, and said second end of the pivot link member is mechanically connected to said slide body.

13. The tensioning device as recited in claim 12, wherein said first end of the pivot link member is pivotally connected to said first end of the strap, and said second end of the pivot link member is pivotally connected to said slide body.

14. The tensioning device as recited in claim 2, wherein said collated strip of fasteners slides along said strap, through guide surfaces of the second guide member, and through guide surfaces of the first guide member.

15. A portable fastener-driving tool, comprising:

(a) a housing containing a driving mechanism; (b) a handle attached to said housing; (c) a first guide member proximal to said handle, said first guide member having a first opening and a second opening, said first guide member being capable of directing a collated strip of fasteners between said first and second openings; (d) a fastener driving area at one end of said housing; (e) a fastener indexing portion proximal to said fastener driving area that is capable of receiving said collated strip of fasteners and moving a fastener of the collated strip of fasteners to a driving position; (f) wherein, when actuated, said driving mechanism operates to drive a fastener at said driving position from said collated strip of fasteners; (g) wherein said first guide member and said fastener indexing portion are spaced-apart from one another, and (h) wherein said collated strip of fasteners traverses a distance between said first guide member and said fastener indexing portion; and (j) a tensioning device, comprising:

(i) a longitudinal strap having a first end and a second end, wherein said first end is in communication with said fastener indexing portion, and said second end is in communication with said first guide member; and (ii) a second guide member that is attached to said strap and is capable of receiving said collated strip of fasteners, said second guide member being positioned between said first and second ends of the strap;

wherein: when said collated strip of fasteners is positioned within both said first guide member and said second guide member, and is in communication with said fastener indexing portion, a combination of said strap and said second guide member prevents the collated strip of fasteners from becoming substantially misaligned in a region between said first guide member and said fastener indexing portion.

16. The tool as recited in claim 15, wherein said tensioning device prevents the collated strip of fasteners from substantially (a) sagging, (b) bunching, and (c) becoming tangled.

17. The tool as recited in claim 15, wherein said fasteners comprise screws.

18. The tool as recited in claim 17, wherein said screws exhibit a length of at least two inches.

19. The tool as recited in claim 15, wherein said longitudinal strap is sufficiently stiff between its first and second ends to, without substantial deformation, support a weight of said collated strip of fasteners between said first guide member and said fastener indexing portion.

20. The tool as recited in claim 19, wherein: (a) said longitudinal strap is exhibits a curved profile with at least one bend, between its first and second ends; and (b) said longitudinal strap is sufficiently flexible to move, without breaking, within a curved portion of said first guide member.

21. The tool as recited in claim 15, wherein said first guide member includes: (a) two arcuate halves that exhibit at least one first guide surface for directing a movement of said collated strip of fasteners therethrough, and (b) at least one second guide surface for directing a movement of shanks of the fasteners therethrough, of said collated strip of fasteners.

22. The tool as recited in claim 15, wherein said second guide member comprises a bracket having: (a) at least one third guide surface for directing a movement of said collated strip of fasteners therethrough, and (b) at least one fourth guide surface for directing a movement of shanks of the fasteners therethrough, of said collated strip of fasteners.

23. The tool as recited in claim 15, wherein said fastener indexing portion comprises a slide body with a rotatable sprocket.

24. The tool as recited in claim 23, further comprising: a movable nose piece in said fastener driving area that moves, along with said slide body, in a substantially linear direction when a fastener is driven, and the first end of said strap moves along with said nose piece and slide body;

wherein said collated strip of fasteners does not become substantially misaligned during said movement of the nose piece, slide body, and strap, including when in the fastener driving position.

25. The tool as recited in claim 24, further comprising: a pivot link member that exhibits a first end and a second end, wherein said first end of the pivot link member is mechanically connected to said first end of the strap, and said second end of the pivot link member is mechanically connected to said slide body.

26. The tool as recited in claim 25, wherein said first end of the pivot link member is pivotally connected to said first end of the strap, and said second end of the pivot link member is pivotally connected to said slide body.

27. The tool as recited in claim 15, wherein said collated strip of fasteners slides along said strap, through guide surfaces of the second guide member, and through guide surfaces of the first guide member.

* * * * *

UNITED STATES PATENT AND TRADEMARK OFFICE

CERTIFICATE OF CORRECTION

PATENT NO. : 7,032,482 B1
APPLICATION NO. : 10/953422
DATED : April 25, 2006
INVENTOR(S) : William H. Hoffman It is certified that error appears in the above-identified patent and that said Letters Patent is hereby corrected as shown below:

In claim 7, column 10, line 49, delete “is”.

In claim 20, column 12, line 18, delete “is”.

Signed and Sealed this

Fourth Day of July, 2006

JON W. DUDAS
*Director of the United States Patent and Trademark Office*